US006684600B1

(12) United States Patent
Yang

(10) Patent No.: US 6,684,600 B1
(45) Date of Patent: Feb. 3, 2004

(54) LOADING APPARATUS FOR LOADING A STRIP OF A SOFT MATERIAL INTO A CONTAINER

(76) Inventor: Sheng-Hui Yang, No. 2, Lane 64, Tung-Kuang-Yuan Rd., Tung Dist., Taichung City (TW)

( * ) Notice: Subject to any disclaimer, the term of this patent is extended or adjusted under 35 U.S.C. 154(b) by 0 days.

(21) Appl. No.: 10/190,482

(22) Filed: Jul. 9, 2002

(51) Int. Cl.[7] ..... B65B 61/22; B65B 63/02

(52) U.S. Cl. ..... 53/115; 53/436; 53/438; 53/474; 53/472; 53/135.1; 53/139.5; 53/527

(58) Field of Search ..... 53/115, 435, 436, 53/438, 473, 474, 472, 135.1, 139.5, 527, 237, 238, 240

(56) References Cited

U.S. PATENT DOCUMENTS 2,691,473 A * 10/1954 Gantzer ..... 53/115
2,805,531 A * 9/1957 Dimond ..... 53/506
2,810,245 A * 10/1957 Dimond ..... 53/115
2,817,934 A * 12/1957 Dimond ..... 53/115
2,895,269 A * 7/1959 Lakso et al. ..... 53/429
2,895,273 A * 7/1959 Lakso ..... 53/438
2,895,275 A * 7/1959 Hollis ..... 53/506
3,030,748 A * 4/1962 Moses ..... 53/115
3,066,460 A * 12/1962 Lakso ..... 53/429
3,224,157 A * 12/1965 Lakso ..... 53/473
4,890,753 A * 1/1990 Duryee et al. ..... 215/231
6,505,457 B2 * 1/2003 Grass et al. ..... 53/435
6,598,368 B1 * 7/2003 Haida ..... 53/115

* cited by examiner

*Primary Examiner*—Scott A. Smith
*Assistant Examiner*—Hemant M. Desai
(74) *Attorney, Agent, or Firm*—Lowe Hauptman Gilman & Berner, LLP

(57) ABSTRACT

A loading apparatus for loading a strip of a soft material into a container includes a sleeve member rotatable among first, second and third angular positions. First cylinder unit for pushing the strip of the soft material into the sleeve member at the first angular position. Second cylinder unit for compressing the strip of the soft material in the sleeve member at the second angular position. And a third cylinder unit for pushing the compressed form of the soft material into the container.

7 Claims, 9 Drawing Sheets

LOADING APPARATUS FOR LOADING A STRIP OF A SOFT MATERIAL INTO A CONTAINER

BACKGROUND OF THE INVENTION

1. Field of the Invention

This invention relates to a loading apparatus for loading a strip of a soft material, such as cotton, plastic, or paper, into a container.

2. Description of the Related Art

FIGS. 1 and 2 illustrate a conventional loading apparatus for continuously loading a soft material 20, such as cotton, plastic, or paper, into a series of containers 50 on a container conveyor 101 so as to cover material, such as tablets or capsules, in the containers 50. The loading apparatus includes a support 10 having upper and lower mounting plates 407, 408, a shaft 400 rotatably mounted on the upper and lower mounting plates 407, 408, a rotatable seat 40 mounted on the shaft 400, a pair of diametrically disposed sleeve members 404, 405 mounted on the rotatable seat 40, a supporting plate 300 mounted on the support 10 below the shaft 400 and defining a feed passage for supporting a strip 21 of the soft material 20 that is to be loaded into an adjacent one of the containers 50, and a feeding unit 30 for forming and carrying the strip 21 of the soft material 20 to the feed passage of the supporting plate 300. Each of the sleeve members 404, 405 is rotatable along with the shaft 400 between first and second angular positions. A center portion of the strip 21 of the soft material 20 on the supporting plate 300 is vertically aligned with the first angular position. The container conveyor 101 is mounted on the support 10 for carrying each container 50 to the second angular position. A first cylinder unit 402 is mounted on the support 10 below the supporting plate 300 at a position vertically aligned with the first angular position, and includes a first cylinder and a first piston that is telescopically extendable from the first cylinder for pushing the strip 21 of the soft material 20 into the sleeve member 404 when the sleeve member 404 is positioned at the first angular position and is vertically aligned with the first cylinder unit 402 and the center portion of the strip 21 of the soft material 20. A second cylinder unit 403 is mounted on the support 10 above the supporting plate 300 at a position vertically aligned with the second angular position, and includes a second cylinder and a second piston that is telescopically extendable from the second cylinder for pushing the strip 21 of the soft material 20 in the sleeve member 405 into the container 50 when the sleeve member 405 is positioned at the second angular position and is vertically aligned with the second cylinder unit 403. The feeding unit 30 includes two pairs of nipping-rollers 301, 302 for nipping a source of the soft material 20, and for forming and carrying the strip 21 of the soft material 20 to the supporting plate 300. The strip 21 of the soft material 20 is formed by tearing the source of the soft material 20 by stopping rotation of one of the pairs of the nipping-rollers 301 while continuing rotation of the other pair of the nipping-rollers 302.

The conventional loading apparatus is disadvantageous in that loading of the strip 21 of the soft material 20 from one of the sleeve members 405 into the container 50 via the second cylinder unit 403 is inconvenient and that the quality of covering provided by the strip 21 of the soft material 20 to the contents in the container 50 may be poor. Moreover, tearing of the source of the soft material 20 to form the strip 21 of the soft material 20 tends to slow down the whole process of loading the strip 21 of the soft material 20 into the container 50, and results in fine fibers of cotton that float in the air, thereby polluting the surrounding environment.

SUMMARY OF THE INVENTION

Therefore, it is an object of the present invention to provide a loading apparatus that is capable of overcoming the aforesaid drawbacks of the prior art.

According to the present invention, there is provided a loading apparatus adapted to load a strip of a soft material into a container. The apparatus comprises: a support; a rotatable seat mounted rotatably on the support and rotatable about an axis relative to the support; a vertically extending tubular sleeve member mounted securely on the rotatable seat and rotatable about the axis along with the rotatable seat among first, second, and third angular positions which are angularly spaced apart from one another; a strip forming unit that is adapted to form a source of the soft material into a predetermined length of a strip of the soft material; a feeding unit mounted on the support, defining a horizontally extending feed passage below the sleeve member, and adapted to feed the source of the soft material through the strip forming unit and advance the strip of the soft material along the feed passage to a position vertically aligned with the first angular position; a first cylinder unit mounted on the support and having a vertically extending first cylinder and a first piston that is telescopically extendable from the first cylinder, the first cylinder being disposed below the feed passage at a position vertically aligned with the first angular position, the sleeve member being vertically aligned with the first cylinder when the sleeve member is turned to the first angular position so as to permit the strip of the soft material on the feed passage to be pushed into the sleeve member by the first piston when the first piston extends outwardly from the first cylinder into the sleeve member; a buffering unit mounted securely on the support and including a spring-biased abutting member that is disposed below the sleeve member at a position vertically aligned with the second angular position; a second cylinder unit mounted on the support and having a vertically extending second cylinder and a second piston that is telescopically extendable from the second cylinder, the second cylinder being disposed above the sleeve member at a position vertically aligned with the second angular position, the sleeve member being vertically aligned with the second cylinder and the spring-biased abutting member when the sleeve member is turned to the second angular position so as to permit the strip of the soft material in the sleeve member to be pressed into a compact form of the soft material by the second piston when the second piston extends outwardly from the second cylinder into the sleeve member and presses the strip of the soft material against the spring-biased abutting member; a container conveyor adapted to carry the container to the third angular position; and a third cylinder unit mounted on the support and having a third cylinder and a third piston that is telescopically extendable from the third cylinder. The third cylinder is disposed above the sleeve member at a position aligned with the third angular position. The sleeve member is vertically aligned with the third cylinder and the container when the sleeve member is turned to the third angular position so as to permit the compact form of the soft material in the sleeve member to be pushed into the container by the third piston when the third piston extends outwardly from the third cylinder through the sleeve member and into the container.

BRIEF DESCRIPTION OF THE DRAWINGS

In drawings which illustrate a preferred embodiment of the invention.

DETAILED DESCRIPTION OF THE PREFERRED EMBODIMENT

Figure 1:
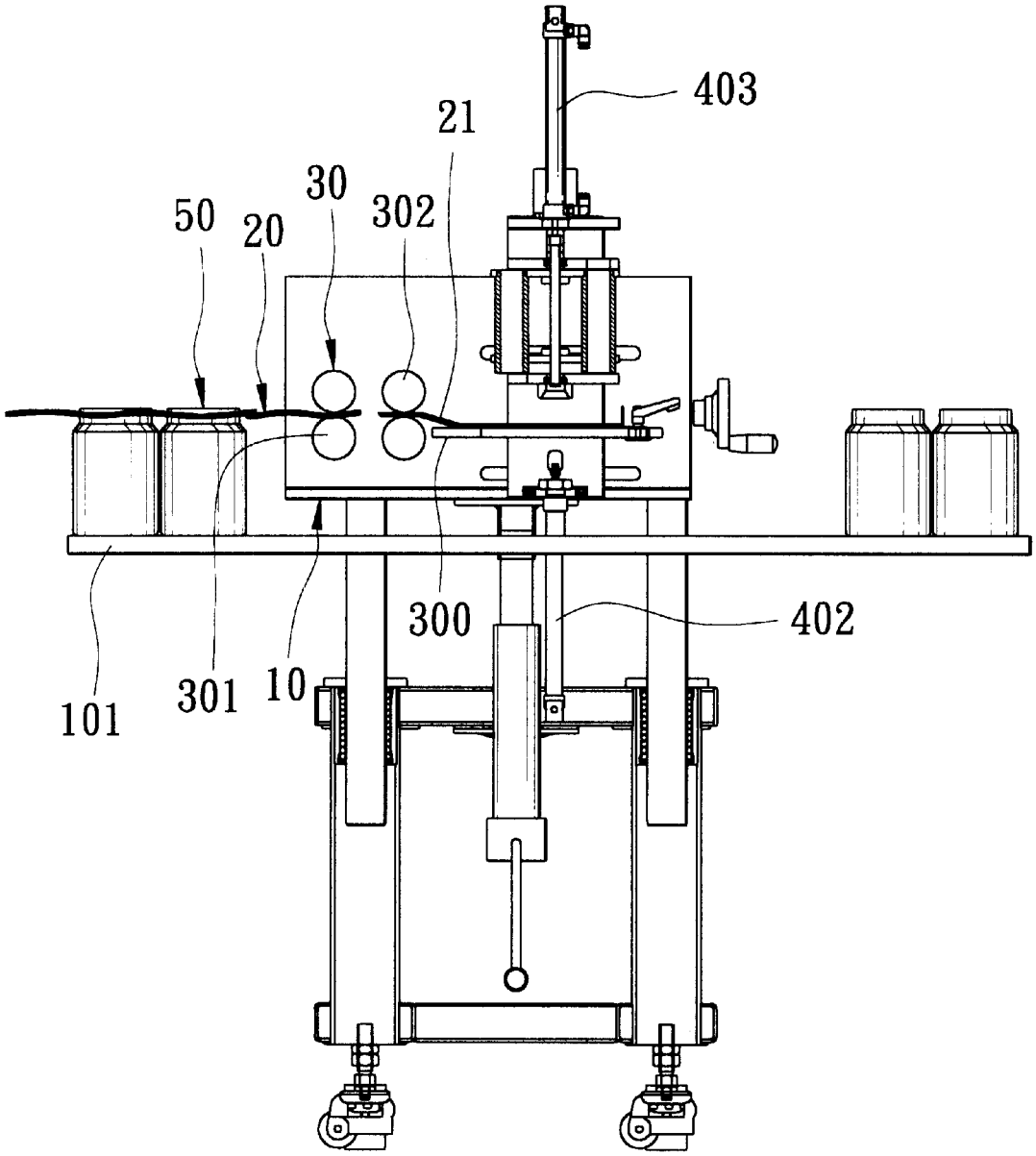
FIG. 1 PRIOR ART
FIG. 1 is a schematic side view of a conventional loading apparatus.
Figure 2:
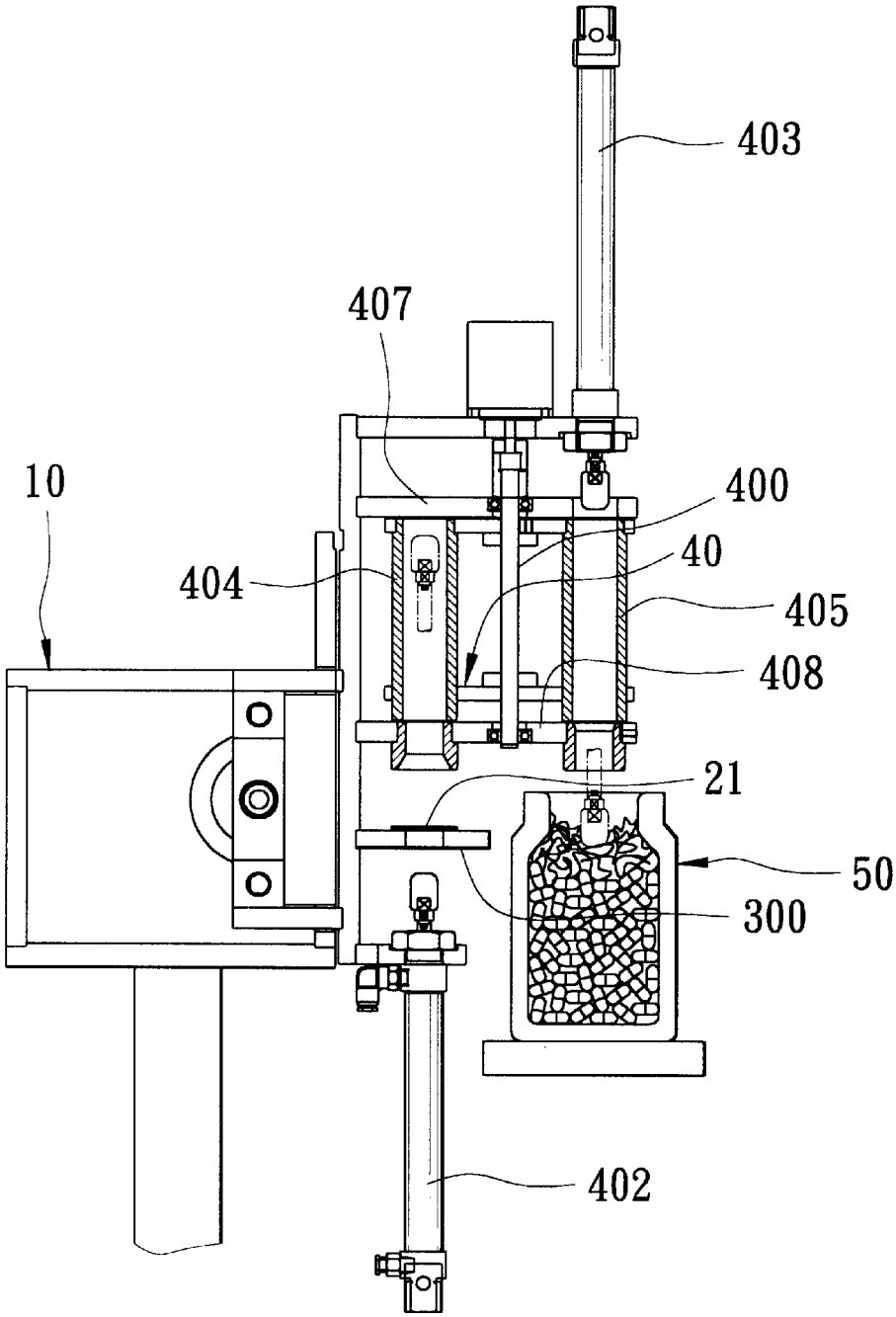
FIG. 2 PRIOR ART
FIG. 2 is a fragmentary schematic sectional side view of the apparatus of FIG. 1.
Figure 3:
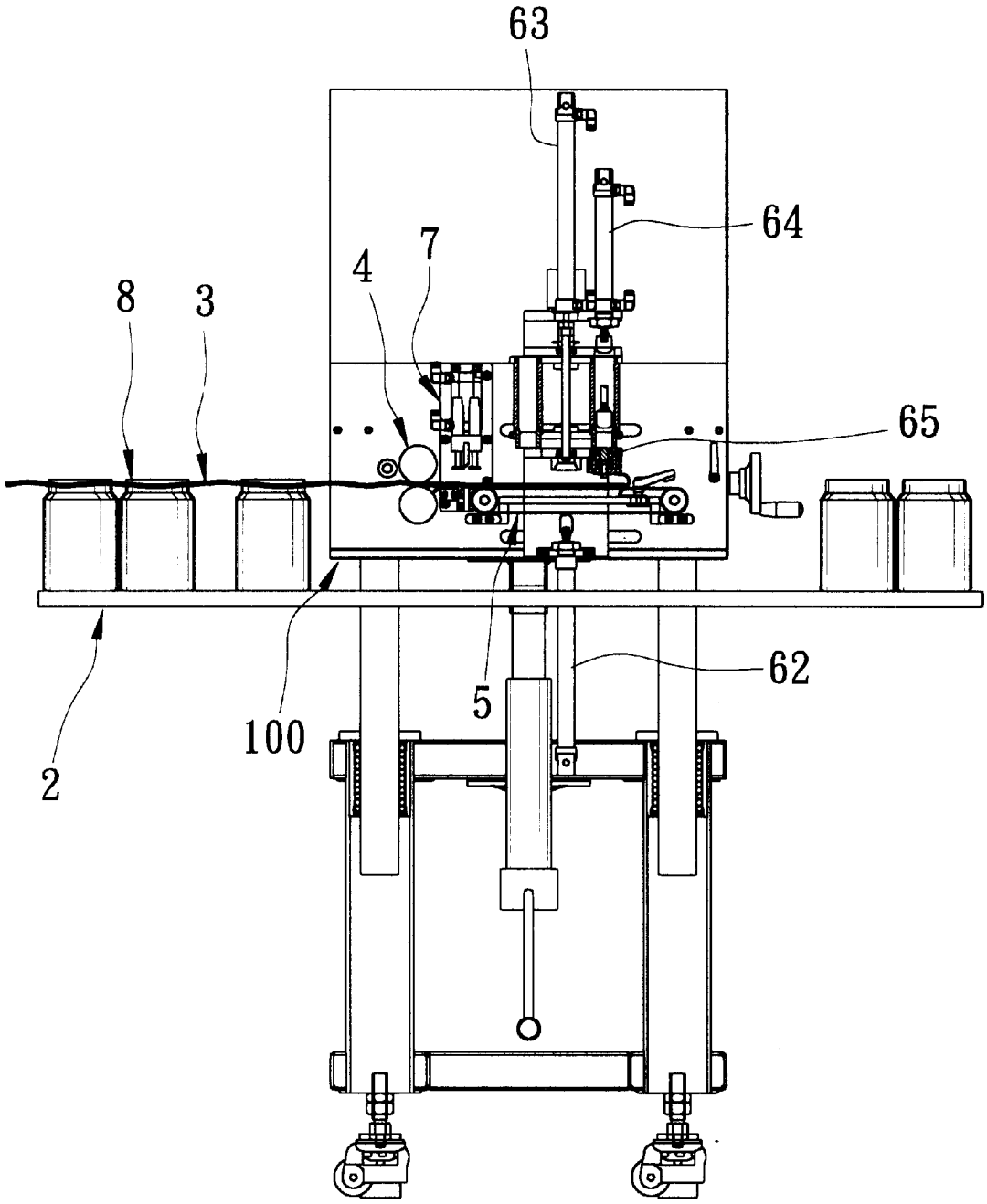
FIG. 3 is a schematic side view of a loading apparatus embodying this invention.
Figure 4:
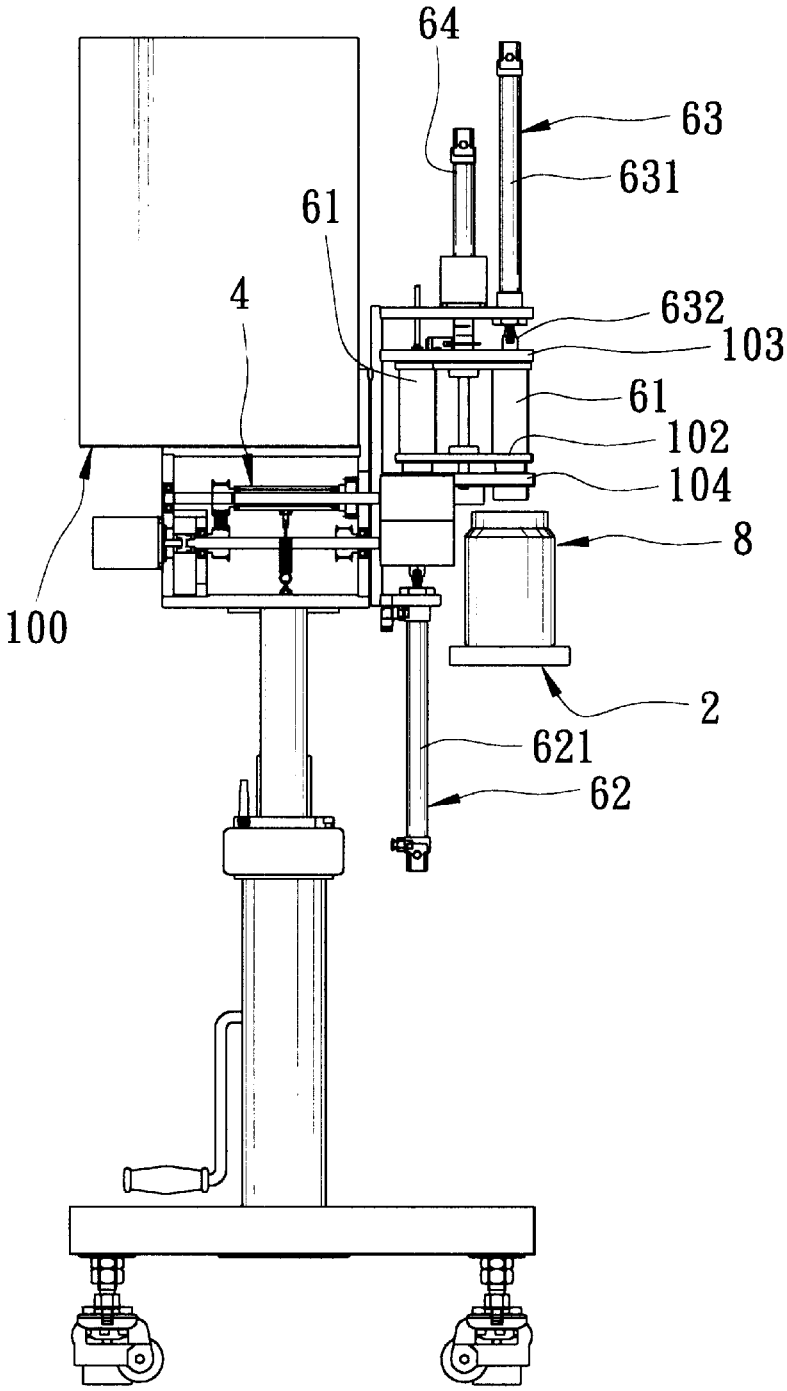
FIG. 4 is another schematic side view of the apparatus of FIG. 3.
Figure 5:
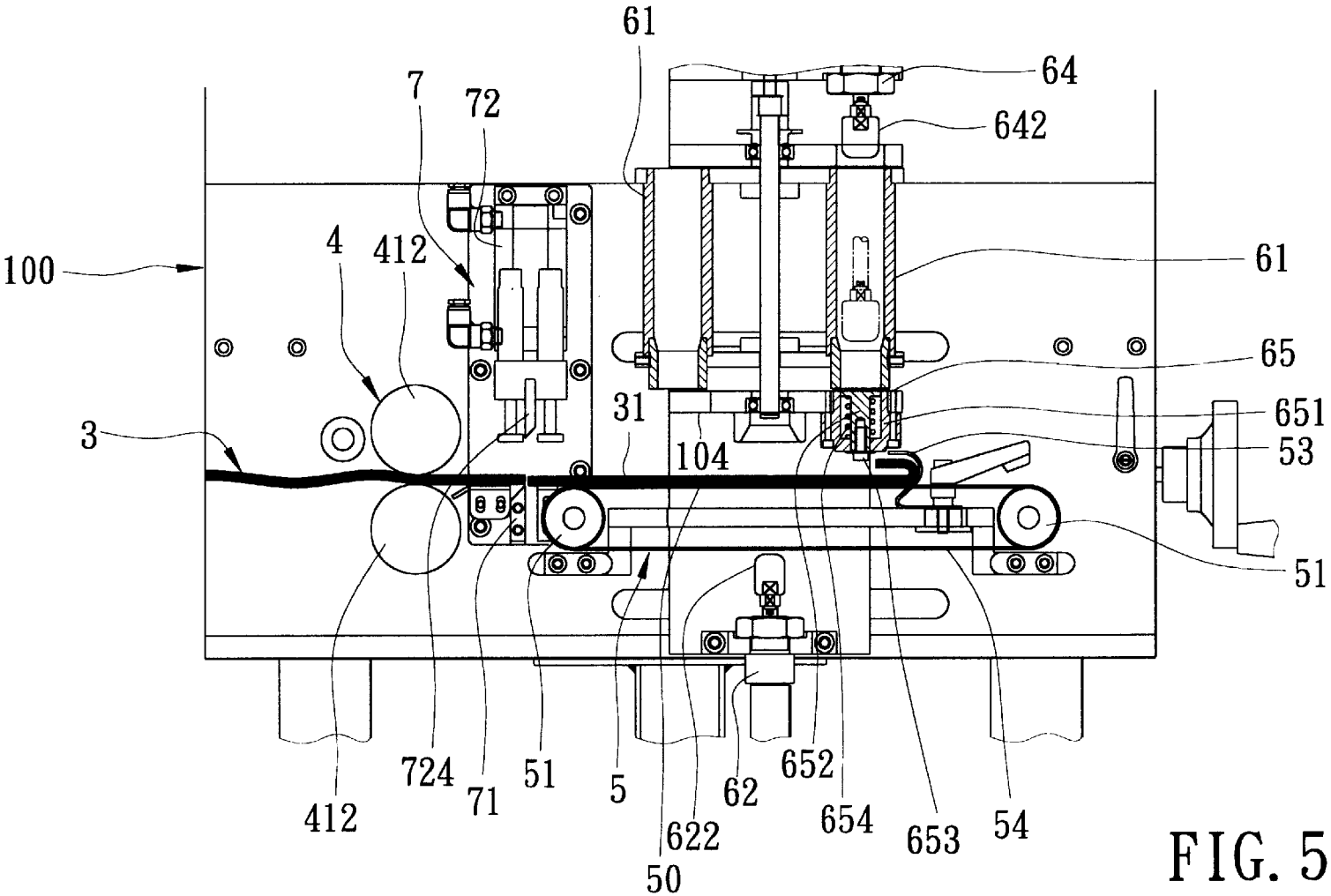
FIG. 5 is a fragmentary schematic sectional side view of the apparatus of FIG. 3.
Figure 6:
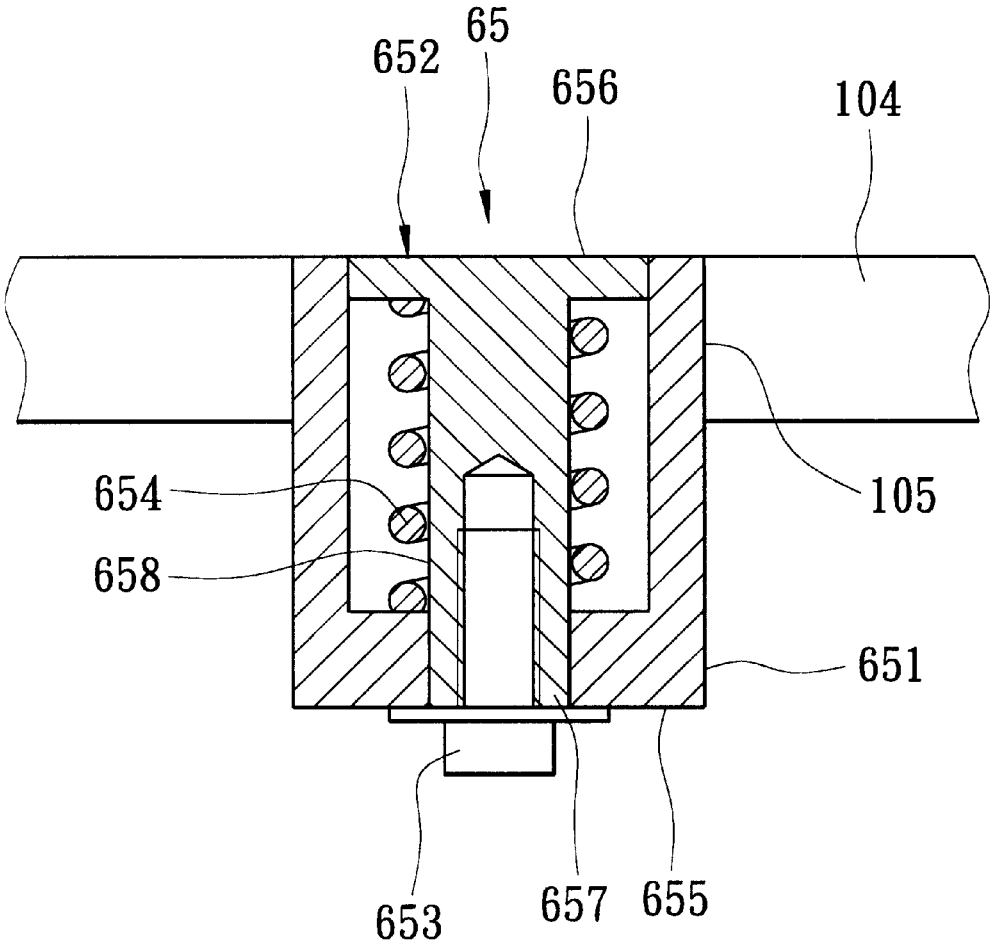
FIG. 6 is a schematic sectional view to illustrate a buffering unit of the apparatus of FIG. 3.
Figure 7:
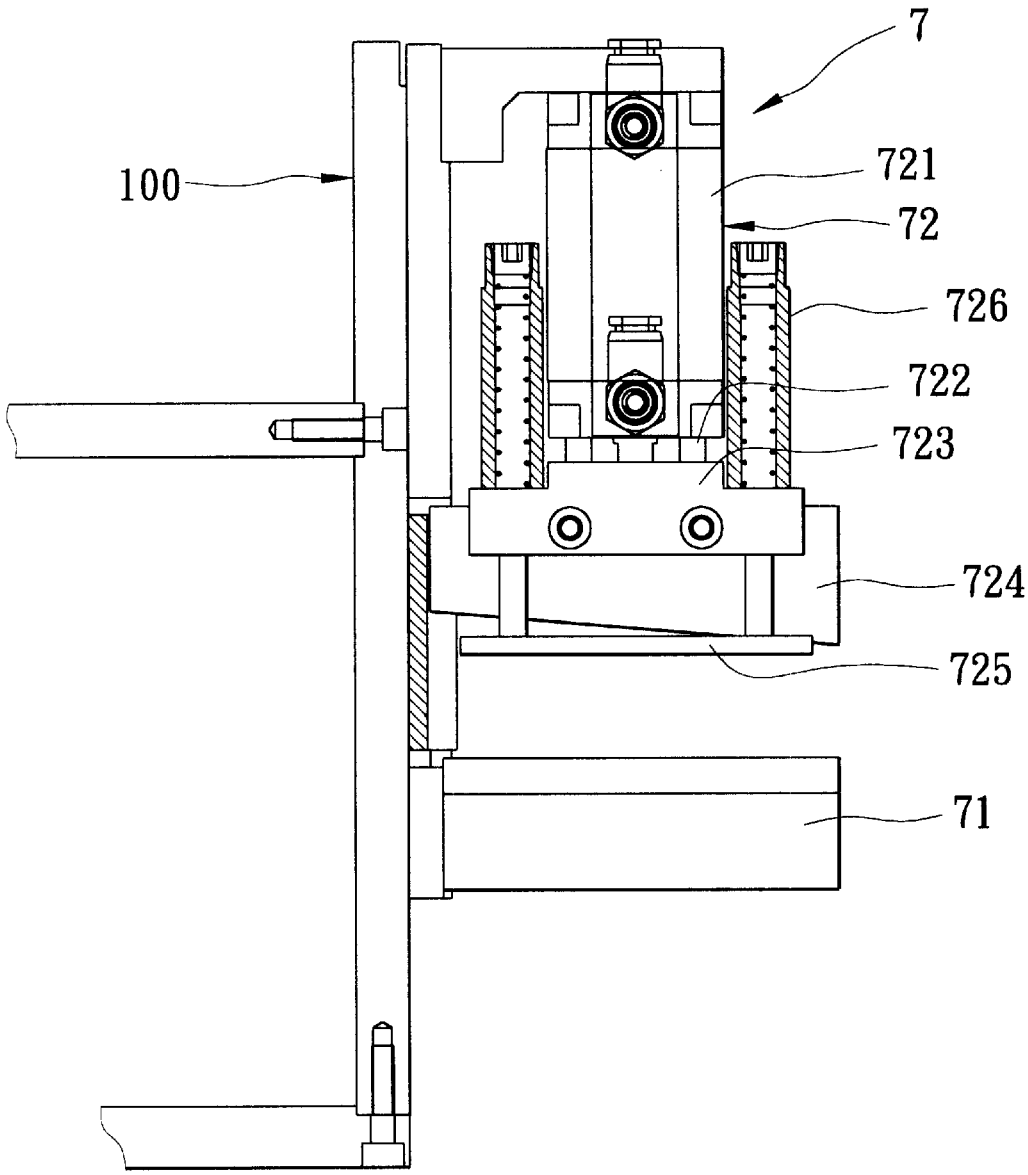
FIG. 7 is another fragmentary schematic sectional side view to illustrate a strip forming unit of the apparatus of FIG. 3.

FIGS. 3 to 9 illustrate a preferred embodiment of a loading apparatus of this invention for continuously loading a soft material 3, such as cotton, plastic, or paper, into a series of containers 8.

The apparatus includes: a support 100; a rotatable seat 102 mounted rotatably on the support 100 and rotatable about an axis relative to the support 100; four vertically extending tubular sleeve members 61 mounted securely on the rotatable seat 102 and equiangularly spaced apart from one another, each of the sleeve members 61 being rotatable about the axis along with the rotatable seat 102 among first, second, third, and fourth angular positions (W, X, Y, Z) which are equiangularly spaced apart from one another so that each sleeve member 61 will go through the first, second, third, and fourth angular positions (W, X, Y, Z) to complete a loading cycle for loading a strip 31 of the soft material 3 into one of the containers 8; a strip forming unit 7 for forming a source of the soft material 3 into a predetermined length of the strip 31 of the soft material 3; a feeding unit 4 mounted on the support 100, defining a horizontally extending feed passage 50 below the sleeve members 61, and adapted to feed the source of the soft material 3 through the strip forming unit 7 and advance the strip 31 of the soft material 3 along the feed passage 50 to a position vertically aligned with the first angular position (W) ; a first cylinder unit 62 mounted on the support 100 and having a vertically extending first cylinder 621 and a first piston 622 that is telescopically extendable from the first cylinder 621, the first cylinder 621 being disposed below the feed passage 50 at a position vertically aligned with the first angular position (W), one of the sleeve members 61 being vertically aligned with the first cylinder 621 when said one of the sleeve members 61 is turned to the first angular position (W) (see FIGS. 4 and 8) so as to permit the strip 31 of the soft material 3 on the feed passage 50 to be pushed into said one of the sleeve members 61 by the first piston 622 when the first piston 622 extends outwardly from the first cylinder 621 into said one of the sleeve members 61; a buffering unit 65 mounted securely on the support 100 and including a spring-biased abutting member 652 that is disposed below the sleeve members 61 at a position vertically aligned with the second angular position (X) (see FIG. 5); a second cylinder unit 64 mounted on the support 100 and having a vertically extending second cylinder 641 and a second piston 642 that is telescopically extendable from the second cylinder 641, the second cylinder 641 being disposed above the sleeve members 61 at a position vertically aligned with the second angular position (X), said one of the sleeve members 61 being vertically aligned with the second cylinder 641 and the spring-biased abutting member 652 when said one of the sleeve members 61 is turned to the second angular position (X) so as to permit the strip 31 of the soft material 3 in said one of the sleeve members 61 to be pressed into a compact form of the soft material 3 by the second piston 642 when the second piston 642 extends outwardly from the second cylinder 641 into said one of the sleeve members 61 and presses the strip 31 of the soft material 3 against the spring-biased abutting member 652 (see FIGS. 3 and 5); a container conveyor 2 adapted to carry each container 8 to the third angular position (Y); and a third cylinder unit 63 mounted on the support 100 and having a third cylinder 631 and a third piston 632 that is telescopically extendable from the third cylinder 631. The third cylinder 631 is disposed above the sleeve members 61 at a position aligned with the third angular position (Y). Said one of the sleeve members 61 is vertically aligned with the third cylinder 631 and the container 8 positioned at the third angular position (Y) when said one of the sleeve members 61 is turned to the third angular position (Y) so as to permit the compact form of the soft material 3 in said one of the sleeve members 61 to be pushed into the container 8 by the third piston 632 when the third piston 632 extends outwardly from the third cylinder 631 through said one of the sleeve members 61 and into the container 8.

The support 100 includes horizontally extending upper and lower mounting plates 103, 104. The rotatable seat 102 is mounted on the upper and lower mounting plates 103, 104. The lower mounting plate 104 is formed with a through-hole 105. The buffering unit 65 further includes a tubular mounting piece 651 mounted on the lower mounting plate 104, extending through the through-hole 105 in the lower mounting plate 104, and having a bottom end wall 655. The spring-biased abutting member 652 includes a T-shaped piece mounted movably in the mounting piece 651 and having a head 656, a tail 657 that is opposite to the head 656 and that extends through the bottom end wall 655 of the mounting piece 651, and a stem 658 interconnecting the tail 657 and the head 656. The spring-biased abutting member 652 further includes a coil spring 654 sleeved around the stem 658 and abutting against the head 656 and the bottom end wall 655 so as to provide a buffering function when the second piston 642 presses the strip 31 of the soft material 3 in said one of the sleeve members 61 against the spring-biased abutting member 652. A screw rod 653 extends through the through-hole 105 in the lower mounting plate 104, and threadedly engages an inner threaded hole in the stem 658 of the T-shaped piece so as to prevent removal of the spring-biased abutting member 652 from the mounting piece 651.

The feeding unit 4 includes a pair of nipping-rollers 412 adapted to nip the source of the soft material 3 for advancing the source of the soft material 3 through the strip forming unit 7 to the first angular position (W), and a belt conveyor 5 downstream of the nipping-rollers 412 and including a pair of opposing belt-rollers 51 and two parallel belts 54 that are trained over the belt-rollers 51, that are spaced apart from each other by a gap 52 for passage of the first piston 622 into said one of the sleeve members 61, and that cooperately define the feed passage 50 for receiving the source of the soft material 3 from the nipping-rollers 412. The strip forming unit 7 is disposed between the nipping-rollers 412 and the belt conveyor 5 for cutting the source of the soft material 3 into the strip 31 of the soft material 3.

The strip forming unit 7 includes a cutting board 71 mounted on the support 100 and adapted to support the source of the soft material 3 thereon, and a cutter 724 mounted movably on the support 100 and disposed above and vertically aligned with the cutting board 71 so as to cut the source of the soft material 3 on the cutting board 71 into the strip 31 of the soft material 3.

The strip forming unit 7 further includes a fourth cylinder unit 72 that is mounted on the support 100, that is disposed above the feed passage 50, and that includes a fourth cylinder 721 and a fourth piston 722 telescopically extendable from the fourth cylinder 721 toward the source of the soft material 3, and a cutter seat 723 secured to the fourth piston 722. The cutter 724 is mounted on the cutter seat 723 so as to be movable along with the fourth piston 722.

The strip forming unit 7 further includes a spring-biased pressing member 725 that is connected to a cushioning member 726, and that is secured to the cutter seat 723 so as to be movable along with the cutter seat 723 toward the cutting board 71 and so as to press the source of the soft material 3 on the cutting board 71, thereby facilitating cutting of the source of the soft material 3.

The feeding unit 4 further includes a curved guiding plate 53 that is mounted on the support 100 at a position adjacent to one of the belt rollers 51, which is distal from the nipping-rollers 412, below the belts 54, and that projects upwardly and curvedly through the gap 52 in a direction toward the other one of the belt rollers 51 in such a manner that when a long strip of the soft material 3 is to be loaded into the container 8, the source of the soft material 3 on the feed passage 50 will contact the guiding plate 53 and will bend according to the curvature of the guiding plate 53 when advancing to the guiding plate 53, thereby expediting the feeding of the source of the soft material 3 to the first angular position (W) via the nipping-rollers 412 as compared to the aforesaid feeding unit of the conventional loading apparatus of FIG. 1.

Figure 8:
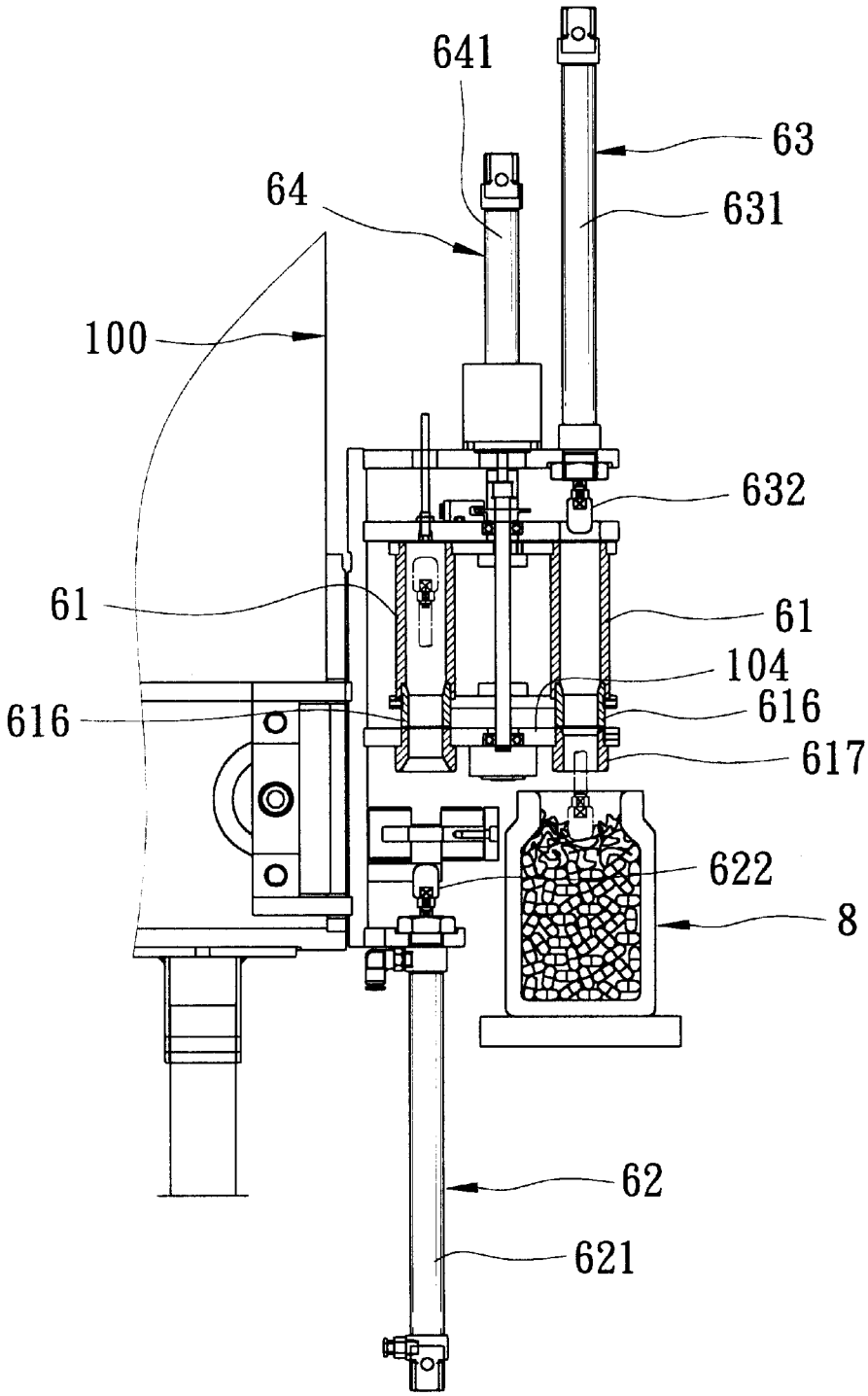
FIG. 8 is a fragmentary schematic sectional side, view to illustrate how a strip of a soft material is loaded into a container via a cylinder unit of the apparatus of FIG. 3.
Figure 9:
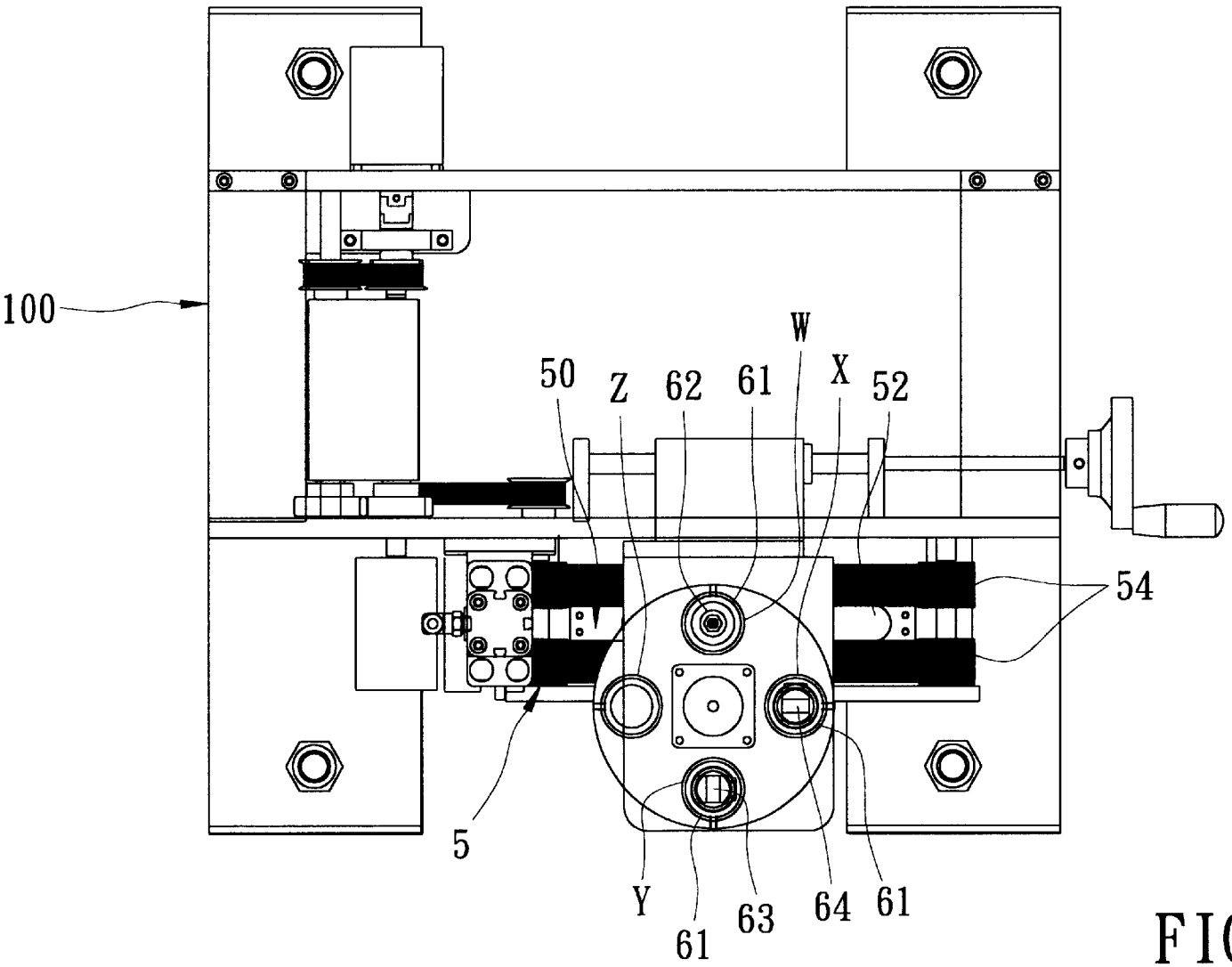
FIG. 9 is a schematic top view of the apparatus of FIG. 3.

Referring now to FIG. 8, a coupling member 616 is detachably connected to a bottom end of each sleeve member 61. A guiding member 617 is mounted on and extends through the lower mounting plate 104, and is vertically aligned with the third angular position (Y). The coupling member 616 on said one of the sleeve members 61 is vertically aligned with the guiding member 617 when said one of the sleeve members 61 is rotated to the third angular position so as to permit loading of the strip 31 of the soft material 3 from said one of the sleeve members 61 into the container 8. With the inclusion of the coupling member 616, the loading apparatus of this invention permits the use of various dimensions of the guiding members 617 so as to suit different containers with entrances that differ in dimension.

It should be noted that the fourth angular position (Z) corresponds to a preparation stage in preparation for a subsequent loading operation.

With the inclusion of the buffering unit 65 and the strip forming unit 7, the aforesaid drawbacks as encountered in the prior art can be eliminated.

With the invention thus explained, it is apparent that various modifications and variations can be made without departing from the spirit of the present invention. It is therefore intended that the invention be limited only as recited in the appended claims.

I claim:

1. A loading apparatus adapted to load a strip of a soft material into a container, said loading apparatus comprising:

a support;

a rotatable seat mounted rotatably on said support and rotatable about an axis relative to said support;

a vertically extending tubular sleeve member mounted securely on said rotatable seat and rotatable about said axis along with said rotatable seat among first, second, and third angular positions which are angularly spaced apart from one another;

a strip forming unit that is adapted to form a source of the soft material into a predetermined length of a strip of the soft material;

a feeding unit mounted on said support, defining a horizontally extending feed passage below said sleeve member, and adapted to feed the source of the soft material through said strip forming unit and advance the strip of the soft material along said feed passage to a position vertically aligned with said first angular position;

a first cylinder unit mounted on said support and having a vertically extending first cylinder and a first piston that is telescopically extendable from said first cylinder, said first cylinder being disposed below said feed passage at a position vertically aligned with said first angular position, said sleeve member being vertically aligned with said first cylinder when said sleeve member is turned to said first angular position so as to permit the strip of the soft material on said feed passage to be pushed into said sleeve member by said first piston when said first piston extends outwardly from said first cylinder into said sleeve member;

a buffering unit mounted securely on said support and including a spring-biased abutting member that is disposed below said sleeve member at a position vertically aligned with said second angular position;

a second cylinder unit mounted on said support and having a vertically extending second cylinder and a second piston that is telescopically extendable from said second cylinder, said second cylinder being disposed above said sleeve member at a position vertically aligned with said second angular position, said sleeve member being vertically aligned with said second cylinder and said spring-biased abutting member when said sleeve member is turned to said second angular position so as to permit the strip of the soft material in the sleeve member to be pressed into a compact form of the soft material by said second piston when said second piston extends outwardly from said second cylinder into said sleeve member and presses the strip of the soft material against said spring-biased abutting member;

a container conveyor adapted to carry the container to said third angular position; and a third cylinder unit mounted on said support and having a third cylinder and a third piston that is telescopically extendable from said third cylinder, said third cylinder being disposed above said sleeve member at a position aligned with said third angular position, said sleeve member being vertically aligned with said third cylinder and the container when said sleeve member is turned to said third angular position so as to permit the compact form of the soft material in said sleeve member to be pushed into the container by said third piston when said third piston extends outwardly from said third cylinder through said sleeve member and into the container.

2. The loading apparatus of claim 1, wherein said support includes horizontally extending upper and lower mounting plates, said rotatable seat being mounted on said upper and lower mounting plates, said lower mounting plate being formed with a through-hole, said buffering unit further including a tubular mounting piece mounted on said lower mounting plate, extending through said through-hole in said lower mounting plate, and having a bottom end wall, said spring-biased abutting member including a T-shaped piece mounted movably in said mounting piece and having a head, a tail that is opposite to said head and that extends through said bottom end wall of said mounting piece, and a stem interconnecting said tail and said head, said spring-biased abutting member further including a coil spring sleeved around said stem and abutting against said head and said bottom end wall so as to provide a buffering function when said second piston presses the strip of the soft material in said sleeve member against said spring-biased abutting member.

3. The loading apparatus of claim 1, wherein said feeding unit includes a pair of nipping-rollers adapted to nip the source of the soft material for advancing the source of the soft material through said strip forming unit to said first angular position, and a belt conveyor downstream of said nipping-rollers and including a pair of opposing belt-rollers and two parallel belts that are trained over said belt-rollers, that are spaced apart from each other by a gap for passage of said first piston into said sleeve member, and that cooperately define said feed passage for receiving the source of the soft material from said nipping-rollers, said strip forming unit being disposed between said nipping-rollers and said belt conveyor for cutting the source of the soft material into the strip of the soft material.

4. The loading apparatus of claim 3, wherein said strip forming unit includes a cutting board mounted on said support and adapted to support the source of the soft material thereon, and a cutter mounted movably on said support and disposed above and vertically aligned with said cutting board so as to cut the source of the soft material on said cutting board into the strip of the soft material.

5. The loading apparatus of claim 4, wherein said strip forming unit further includes a fourth cylinder unit that is mounted on said support, that is disposed above said feed passage, and that includes a fourth cylinder and a fourth piston telescopically extendable from said fourth cylinder toward the source of the soft material, and a cutter seat secured to said fourth piston, said cutter being mounted on said cutter seat so as to be movable along with said fourth piston.

6. The loading apparatus of claim 5, wherein said strip forming unit further includes a spring-biased pressing member that is secured to said cutter seat and that is movable along with said cutter seat toward said cutting board so as to press the source of the soft material on said cutting board, thereby facilitating cutting of the source of the soft material.

7. The loading apparatus of claim 3, wherein said feeding unit further includes a curved guiding plate that is mounted on said support at a position adjacent to one of said belt rollers, which is distal from said nipping-rollers, below said belts, and that projects upwardly and curvedly through said gap in a direction toward the other one of said belt rollers in such a manner that movement of the source of the soft material on said feed passage toward said guiding plate results in folding of the source of the soft material.

* * * * *